US010934884B2

(12) United States Patent
Onfray et al.

(10) Patent No.: US 10,934,884 B2
(45) Date of Patent: Mar. 2, 2021

(54) ASSEMBLY FOR A TURBINE ENGINE

(71) Applicant: SAFRAN AIRCRAFT ENGINES, Paris (FR)

(72) Inventors: Rémi Philippe Guy Onfray, Moissy-Cramayel (FR); Benoit André Pierre Frossard, Moissy-Cramayel (FR); Clément Miraton, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/369,972

(22) Filed: Mar. 29, 2019

(65) Prior Publication Data

US 2019/0301299 A1 Oct. 3, 2019

(30) Foreign Application Priority Data

Mar. 30, 2018 (FR) ..... 1852852

(51) Int. Cl.
*F01D 17/16* (2006.01)
*F04D 29/56* (2006.01)

(52) U.S. Cl.
CPC ..... *F01D 17/162* (2013.01); *F04D 29/563* (2013.01); *F05D 2230/642* (2013.01); *F05D 2240/128* (2013.01); *F05D 2240/54* (2013.01); *F05D 2250/241* (2013.01); *F05D 2250/711* (2013.01); *F05D 2260/38* (2013.01)

(58) Field of Classification Search
CPC ..... F04D 29/56; F04D 29/563; F04D 29/564; F01D 17/162
See application file for complete search history.

(56) References Cited

U.S. PATENT DOCUMENTS 6,481,960 B2 * 11/2002 Bowen ..... F01D 11/001 415/160
7,670,106 B2 * 3/2010 Bouru ..... F01D 9/042 415/148

(Continued)

FOREIGN PATENT DOCUMENTS

EP 3 299 589 A1 3/2018
EP 3517737 A1 7/2019

(Continued)

OTHER PUBLICATIONS

French Patent Application No. 1852852, Search Report dated Jan. 28, 2019—10 pgs. (in French; relevance found in the citations).

*Primary Examiner* — Richard A Edgar
(74) *Attorney, Agent, or Firm* — Lathrop GPM LLP

(57) ABSTRACT

An assembly (50) for a turbine engine includes an annular row of stator blades with a longitudinal axis (B) having variable pitch blades each comprising a radial vane (6), at least one of its ends of which is connected to a radially extending pivot (14) and being engaged in rotation around its axis (A) in a ring (16), characterised in that a tubular component (26) is mounted coaxially around the pivot (14), wherein said tubular component (26) comprises a first annular zone (26*a*) mounted tightly on the pivot (14) and a second annular zone (26*b*) comprising an annular bulge (28) extending substantially radially outwards in relation to the axis (A) of the pivot (14), wherein the annular bulge (28) and the pivot (14) define an annular space (30).

17 Claims, 3 Drawing Sheets

(56) References Cited

U.S. PATENT DOCUMENTS

| | | | | |
|---|---|---|---|---|
| 2002/0154991 | A1 | 10/2002 | Bowen | |
| 2007/0160464 | A1* | 7/2007 | Lesnevsky ..... | F01D 5/3092 415/160 |

FOREIGN PATENT DOCUMENTS

| | | | |
|---|---|---|---|
| FR | 2 941 018 | A1 | 7/2010 |
| GB | 774 501 | A | 5/1957 |

* cited by examiner

-- Prior Art --

ASSEMBLY FOR A TURBINE ENGINE

CROSS-REFERENCE TO RELATED APPLICATIONS

This application claims the benefit of priority to French Patent Application No. 1852852, filed Mar. 30, 2018, which is incorporated herein by reference in its entirety.

DOMAIN OF THE INVENTION

The present invention relates to an assembly for a turbine engine, particularly for an aircraft turbojet engine or a turboprop engine.

BACKGROUND

A turbine engine may comprise one or several compressors, comprising an alternation of annular rows of mobile blades or rotor wheels and annular rows of fixed stator blades. The term "stator" in the expression "stator blade" denotes a blade that does not move around the longitudinal axis of the turbine engine. The blades of the stator may be of variable pitch type, in order to adjust their angular position around their axes so as to optimise gas flow in the turbine engine.

FIG. 1 illustrates an annular row of variable pitch stator blades 2, capable of being included in a turbine engine, particularly in a high-pressure compressor.

Each variable pitch stator blade 4 comprises a vane 6 connected to a cylindrical pivot 8, 14 at each of its radially internal and external ends, visible in FIGS. 1 to 3. These internal and external pivots 8, 14 define a longitudinal axis A, visible in FIG. 2, the axis of rotation of the variable pitch stator blade 4 and extend respectively radially inwards and radially outwards in relation to the longitudinal axis of the turbine engine, which corresponds to the axis around which the rotating parts are intended to be rotated.

The radially external pivot 8 of each variable pitch stator blade is fixed to actuating ring 10. In particular, for each annular row of variable pitch stator blades 2, the external pivots 8 are linked by a connecting rod 12 to an actuating ring 10 mounted around an external annular casing of the turbine engine and which is itself connected by a lever a drive shaft actuated by a jack.

As can be seen in FIG. 2, the internal pivot 14 formed at the radially internal end 14 of each variable pitch blade 4 is engaged in a housing of a ring 16, also known as the internal annular shroud. The ring 16, which delimits radially inwards the air stream of the primary air flow and can be sectorised, comprises a plurality of housings 18 evenly distributed around its axis of rotation. Each internal pivot 14 of each variable pitch stator blade 4 is thus engaged in rotation around its axis A in one of the housings 18 of the ring 16.

The variable pitch stator blades 4 furthermore comprise a plate 20 connecting the vane 6 to the radially internal pivot 14. Once the variable pitch stator blades 4 have been mounted on the ring 16, the plates 20 engage in threaded holes 22 in the ring 16, coaxial with the housings 18 in which the internal pivots 14 are installed. The radially external surfaces of the plates 20 form with the radially external face of the ring a wall that delimits radially inwards the annular air stream of the primary air flow.

Mechanical analyses indicate high concentrations of static and dynamic stresses at the radially internal pivot 14 of the variable pitch stator blades 4. Indeed, the aerodynamic pressure and vibration forces applied to the ring 16 contribute to applying stress on the internal pivot 14.

This situation can lead to weakening of the component, appearance of cracks, or even detachment of the internal pivot 14 from the variable pitch stator blade 4.

FIG. 3 illustrates an assembly 40 comprising the internal pivot 14 of a variable pitch stator blade 4 according to the prior art. The assembly 40 thus comprises the internal pivot 14 of a variable pitch stator blade 4, in addition to a tubular component 24, mounted coaxially around the pivot 14.

The tubular component 24 is a cylindrical bushing with a constant radius over its entire height, assembled shrink-fitted on to the internal pivot 14. The tubular component 24, mounted tightly over its entire surface in contact with the pivot 14, therefore reduces wear on the internal pivot 14 of the variable pitch stator blades 4.

Nevertheless, mechanical analyses show that the stresses responsible for wear on the tubular component 24 are mainly concentrated in two contact zones, thereby accelerating wear of the tubular component 24 in these two contact zones.

An object of the invention is to provide a solution to the above-mentioned problem that is simple, effective, and inexpensive.

SUMMARY OF THE INVENTION

For this purpose, the present invention proposes an assembly for a turbine engine comprising an annular row of stator blades with a longitudinal axis having variable pitch blades each comprising a radial vane, at least one of its ends of which is connected to a radially extending pivot and being engaged in rotation around its axis in a ring, characterised in that a tubular component is mounted coaxially around the pivot, wherein said tubular component comprises a first annular zone mounted tightly on the pivot and a second annular zone comprising an annular bulge extending radially outwards in relation to the pivot axis, wherein the annular bulge and the pivot internally define in conjunction with the pivot an annular space.

Unlike the former art wherein the cylindrical tubular component was mounted tightly over its entire surface in contact with the pivot, the invention here proposes that the tubular component have a first annular zone of the tubular component that is mounted tightly so as to hold the tubular component in position, which also includes a second annular zone comprising an annular bulge that delimits an annular space with the pivot, wherein the annular bulge allows radial deformation of said bulge during operation. During assembly, it is stressed so as to allow correct positioning inside a housing of the ring. The tubular component comprises in this case, along the axis of the pivot, a first annular zone mounted tightly on the pivot followed by a second annular zone comprising an annular bulge.

According to the invention, the tubular component can be mounted on the blade pivot such that the first annular zone is interposed along the axis of said pivot between the annular bulge and a vane support plate.

This positioning of the first annular zone of the tubular component in relation to the plate makes it possible to avoid any translation movement of the tubular component towards the plate. Such translational movement might damage the plate during operation.

According to another characteristic of the invention, a third annular zone can be formed on the tubular component along the axis of said pivot such that the second annular zone is interposed between the first annular zone and the third annular zone, wherein the third annular zone comprises an annular face radially internal in relation to the pivot axis in contact with said pivot.

Thus, the tubular component is so shaped as to be mounted tightly on the pivot by means of its first annular zone, with the third annular zone defining an annular clearance with the pivot. When the pivot equipped with the tubular component is installed in the housing of the ring, the annular face of the third annular zone is then placed in contact with the pivot owing to the deformation of the annular bulge. Furthermore, the radially internal annular face is thus radially opposite the pivot in relation to the pivot axis.

Consequently, the annular clearance is adapted so as to ensure adequate sliding and depends on the torques of the materials of which the tubular component is formed and the operating conditions of said turbine engine.

Once the assembly is mounted on the ring, the annular clearance between the third zone of the tubular component and the pivot is no longer visible.

The radially internal annular face may be convex rounded shape.

Such a geometry of the radially internal annular face of the third annular zone makes it possible, during the translational movements of the pivot, to avoid friction against the latter and ensure improved sliding of the pivot.

The annular bulge may comprise a face that is radially internal in relation to the pivot axis which is concave and a face that is radially external in relation to the pivot axis which is convex.

The first zone may be formed at a first end of the tubular component.

The third zone may likewise be formed at a second end of the tubular component.

The pivot may be formed at the end of the blade that is radially internal in relation to the longitudinal axis.

The ring may comprise a plurality of housings, regularly distributed around the axis of the ring. Thus, in particular, each tubular component can be mounted coaxially around a pivot and can be accommodated in one of the housings, such that the radially external face of the annular bulge is stressed radially towards the inside of the housing.

The plurality of housings may also each respectively receive a bush in which a said tubular component surrounding a pivot is engaged.

In particular, on assembly, the annular bulge comes into contact with a radially internal face of the bush, in relation to the pivot axis. This causes blocking of the pivot in the bush in a direction perpendicular to the pivot axis. Likewise, the end of the tubular component opposite that bearing the first annular zone of the tubular component is thus placed in contact with the pivot.

The invention also relates to a turbine engine compressor, such as a high-pressure compressor, characterised in that it comprises at least one assembly as described above.

The invention furthermore relates to a turbine engine, such as a turbojet engine or a turboprop engine, comprising at least one assembly as described above or a compressor as defined in the preceding paragraph.

The invention will be better understood and other details, characteristics and advantages of the invention will appear when reading the following description, which is given as a non-limiting example, with reference to the attached drawings.

DETAILED DESCRIPTION

Figure 1:
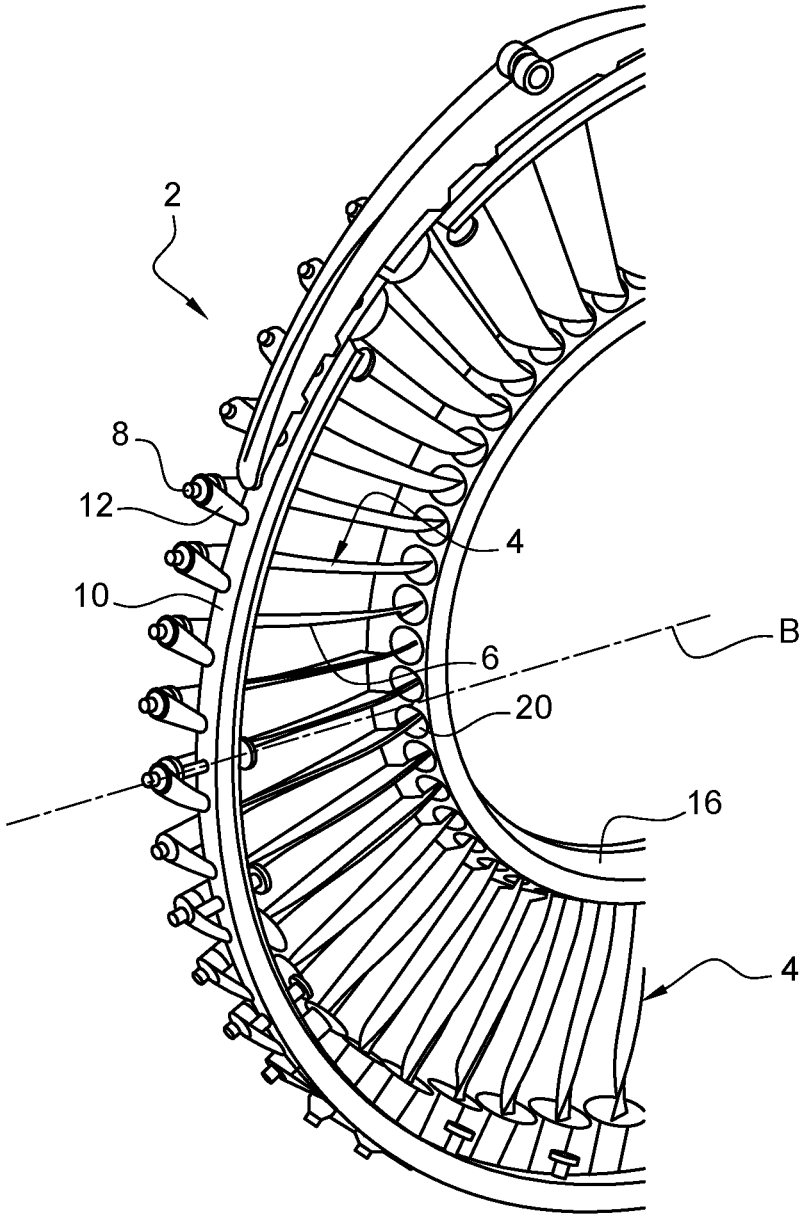
FIG. 1 is a diagrammatic perspective partial view of an annular row of blades of the stators.
Figure 2:
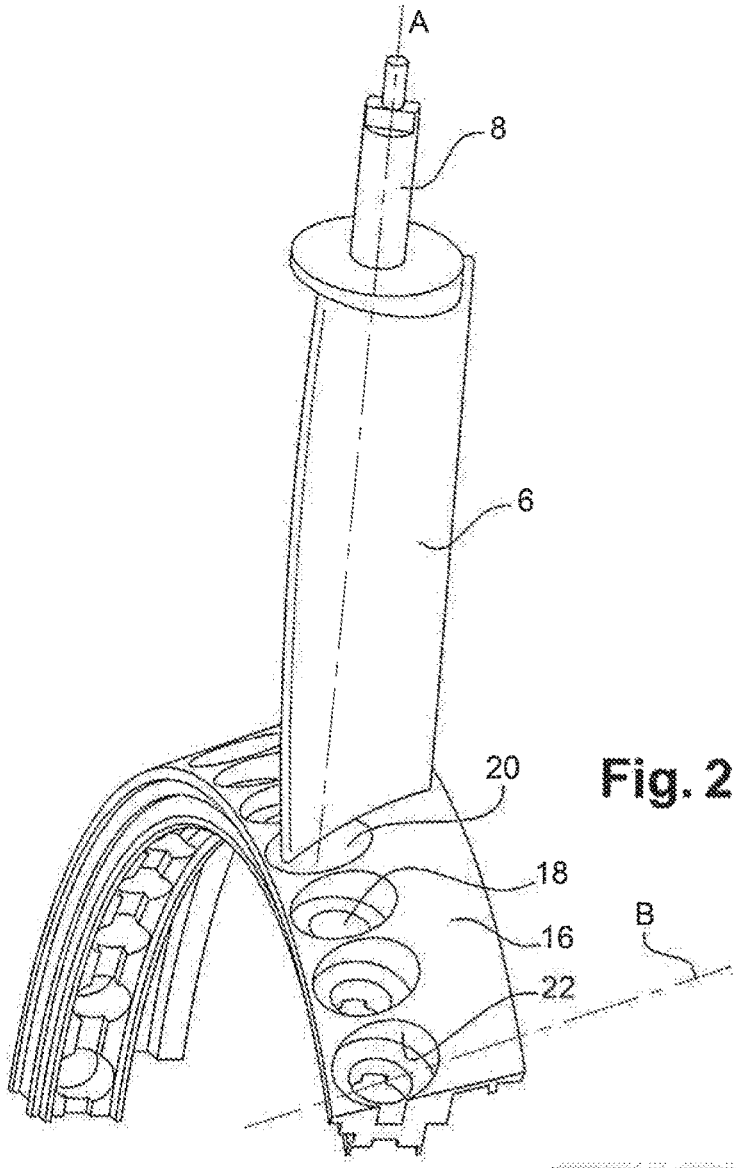
FIG. 2 is a diagrammatic perspective view of a variable pitch stator blade, isolated and mounted on a ring.
Figure 3:
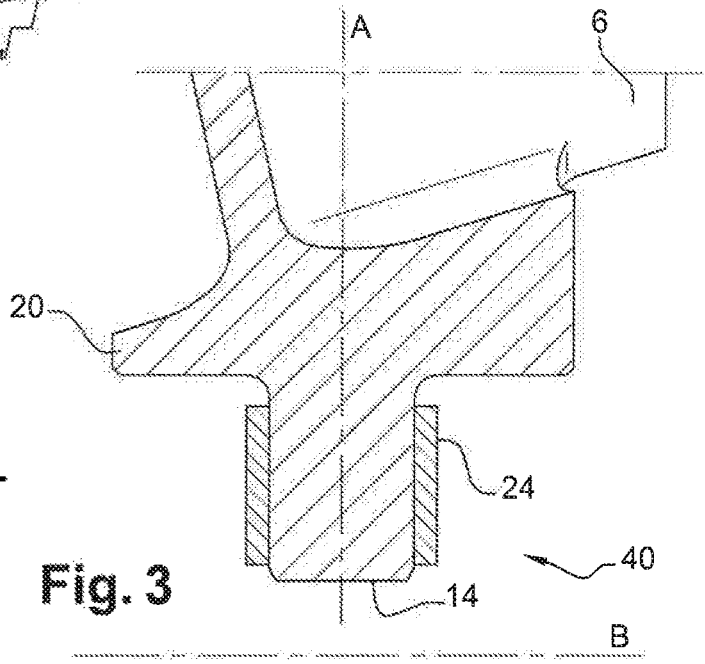
FIG. 3 is a longitudinal cross-sectional view of an assembly comprising the internal pivot of a variable pitch stator blade according to the prior art, mounted on the ring.
Figure 4:
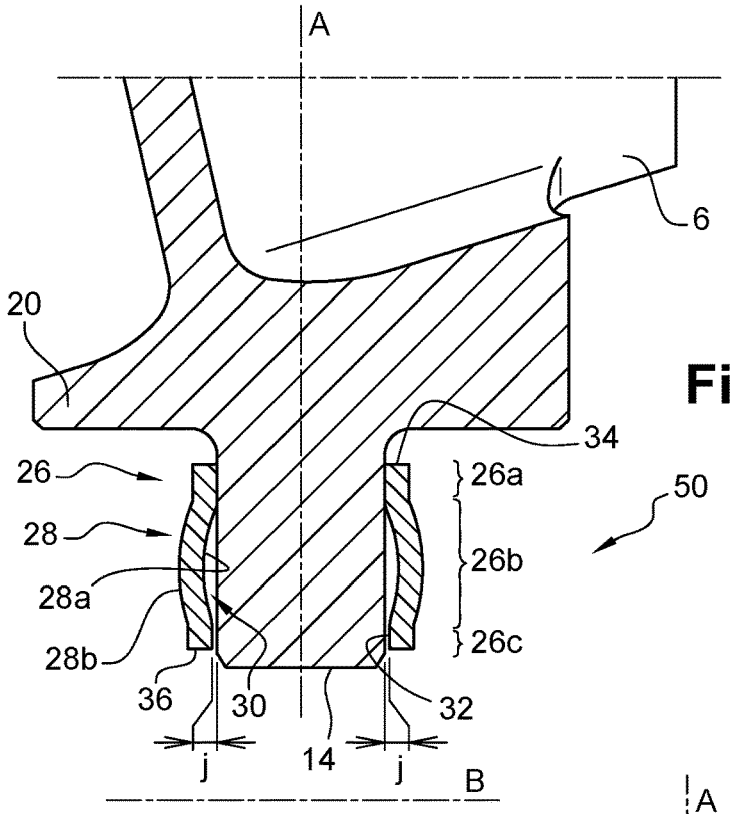
FIG. 4 is a longitudinal cross-sectional view of an assembly comprising the internal pivot of a variable pitch stator blade according to the invention, before mounting on the ring.

Reference is now made to FIG. 4 and following figures in connection with the invention, FIGS. 1 to 3 having already been described above and relating to the known technique.

FIG. 4 illustrates an assembly 50 comprising the internal pivot 14 of a variable pitch stator blade 4 according to the invention, before mounting on the ring 16. As in the prior art, the assembly 50 furthermore comprises a tubular component 26.

The tubular component 26 according to the invention differs from that of the prior art by its geometry. Indeed, the tubular component 26 according to the invention comprises a first annular zone 26*a* mounted tightly, i.e. shrink-fitted, around the pivot 14. The tubular component 26 according to the invention furthermore comprises a second annular zone 26*b*. The second annular zone comprises an annular bulge 28 extending radially outwards in relation to the axis A of the pivot and defining in conjunction with the pivot 14 an annular space 30.

Thus, as can be seen in FIG. 4, the tubular component comprises, along the axis A of the pivot, a first annular zone 26*a* mounted tightly on the pivot 14, followed by a second annular zone 26*b* comprising an annular bulge 28.

The annular bulge 28 of the second zone is defined by a face that is radially internal 28*a* in relation to the pivot axis which is concave and a face that is radially external 28*b* in relation to the pivot axis which is convex. A bulge 28 of this kind can be obtained for example by deformation of a cylindrical tubular component, thus forming a convex annular zone. The tubular component 26 may furthermore exhibit a constant thickness from its first to its second end. The thickness is on the order of 1.5 mm for example, depending on the constituent material of the tubular component.

Such a geometry of the tubular component 26, which in the prior art was mounted tightly on the pivot along the former's entire length, makes it possible, during operation, to guarantee the flexibility and damping of the link between the pivot 14 and the ring 16. Such flexibility relieves the static stresses exerted on the link. Such damping furthermore relieves the vibratory stresses exerted on the link.

With such as geometry, the tubular component 26, as a wearing part, makes it possible to improve the service life of the variable pitch stator blades 4, and in particular that of the internal pivots 14. It thus reduces some of the stresses exerted in the connection area between the pivot 14 and the vane 6 of the variable pitch stator blades 4.

In addition, the geometry of the tubular component 26 allows better control of the areas in which the stresses experienced by the tubular component 26 are concentrated, and thus distribution of the stresses experienced by the tubular component 26 over a surface instead of at contact points, in order to slow the wear of this tubular component 26.

As illustrated in FIG. 4, the tubular component 26 is mounted on the blade pivot 14 such that the first annular zone 26*a* is interposed along the axis A of said pivot between the annular bulge 28 and a support plate 20 of the vane 6. By positioning the tubular component 26 around the pivot 14, the risk of translation of the tubular component 26 towards the plate 20, which may damage the plate 20 is reduced.

A third annular zone 26*c*, visible in FIG. 4, is formed on the tubular component 26. The third annular zone 26*c* is arranged such that the second annular zone 26*b* is interposed between the first annular zone 26*a* and the third annular zone 26*c*.

The third annular zone 26*c* is delimited internally by an annular face 32 that is radially internal in relation to the axis A of the pivot 14. The annular face 32 that is radially internal in relation to the axis A of the pivot 14 of the third zone 26*c* defines with the pivot 14 an annular clearance depending on the torques of the materials used for the design of the tubular component 28 and the operating conditions of said turbine engine, so as to ensure adequate sliding.

Figure 5:
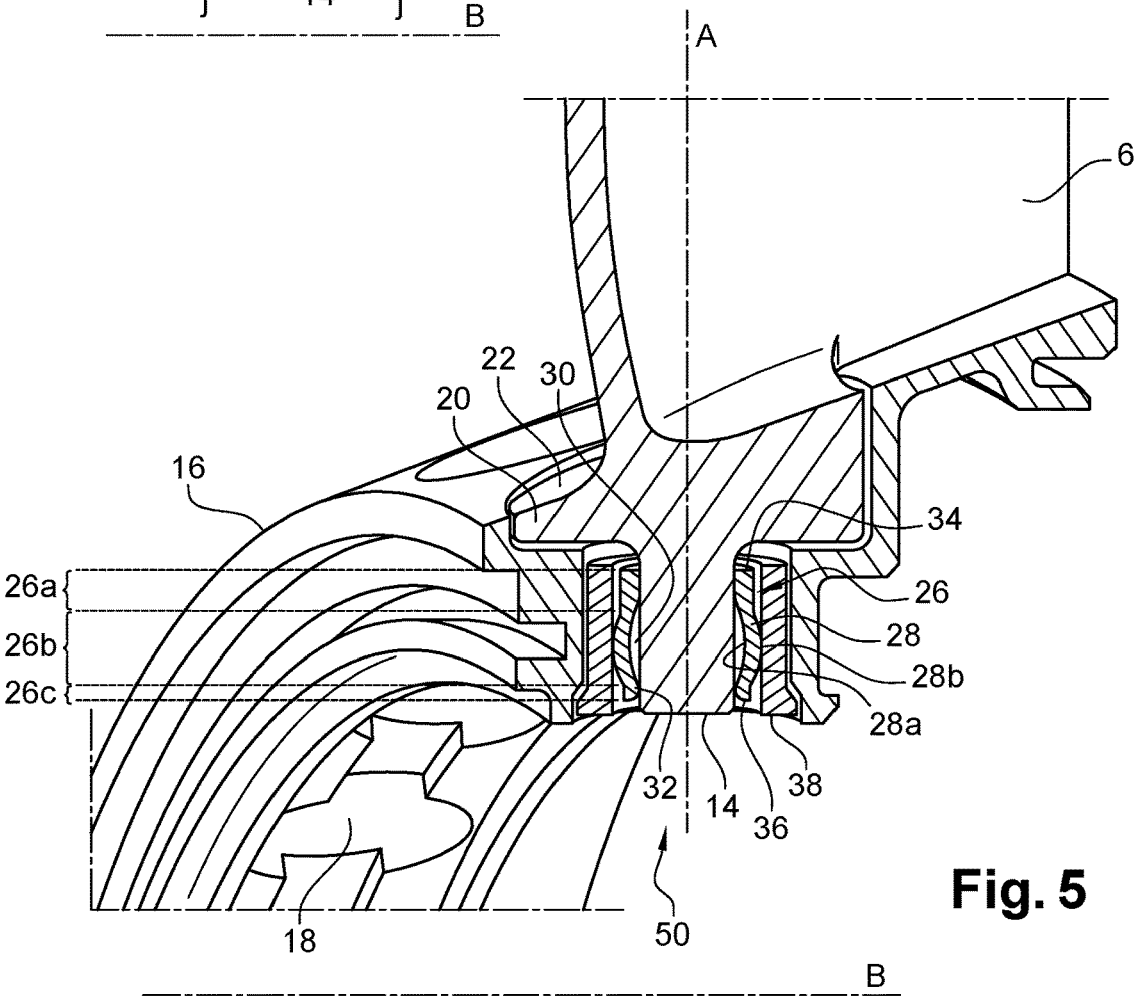
FIG. 5 is a diagrammatic longitudinal cross-sectional view of the assembly in FIG. 4 mounted on the ring.

FIG. 4 represents an intermediate assembly position in which the presence of an annular clearance j is visible. Owing to the clearance j between the third annular zone 26*c* and the pivot 14, the tubular component 26 can relax or tighten radially as a function of the stresses to which it is exposed, applied by the pivot 14. When the assembly is mounted on the ring 16, this annular clearance j between the third annular zone 26*c* and the pivot 14 is abolished (FIG. 5).

The annular face 32 that is radially internal in relation to the pivot of the third zone 26*c* may be convex rounded shape. The convex rounded shape of the annular face 32 makes it possible in particular to avoid the latter's rubbing against the pivot 14 during its translational movements and furthermore ensures improved sliding of the pivot 14.

The first annular zone 26*a* may, in a particular embodiment, be formed at a first end 34 of the tubular component 26, particularly the first end 34 that may be radially external.

In another embodiment of the invention, the third zone 26*c* may be formed at a second end 36 of the tubular component 26, particularly the second end 36 that may be radially internal.

The length of the tubular component 26 is for example such that it covers between 70% and 90% of the pivot.

The first, 26*a*, second 26*b* and third 26*c* annular zones of the tubular component 26 respectively represent approximately 25%, 60% and 15% of the total length of the tubular component.

Mounting of the assembly 50 in FIG. 4 on the ring 16 is illustrated in FIG. 5. As illustrated, once the assembly is mounted on the ring 16, the annular clearance j between the third annular zone 26*c* and the pivot 14 is abolished. The housings 18 in the ring each receive a bush 38 in which the tubular component 26 surrounding a pivot 14 is engaged. The bush 38, a wearing part improving the service life of the pivot 14 and the tubular component 26 during operation, is integral with the housing 18.

As can be seen in FIG. 5, the housing 18 is delimited by an annular wall of axis A. In practice, it is noticed that the radially external face 28*b* of the annular bulge 28 abuts radially outwards against an internal annular face of the bush 38, as a result of prestressed installation of the annular bulge 28 in the bush 38. The bush 38 is fixedly installed inside the housing 18, i.e. inside the annular wall delimiting the housing 18. Angular setting of a blade 4 around its axis A is carried out by rotating the pivot 14, with the tubular component 26 integral with the pivot 14 moving in rotation around the axis A in relation to the bush 38.

The invention claimed is:

1. Assembly (50) for a turbine engine comprising an annular row of stator blades (2) with a longitudinal axis (B) having variable pitch blades (4) each comprising a radial vane (6), at least one of its ends of which is connected to a radially extending pivot (8, 14) and being engaged in rotation around its axis (A) in a ring (16), characterised in that a tubular component (26) is mounted coaxially around the pivot (8,14), wherein said tubular component (26) comprises a first annular zone (26*a*) mounted tightly on the pivot (8,14) and a second annular zone (26*b*) comprising an annular bulge (28) extending substantially radially outwards in relation to the axis (A) of the pivot (8,14), wherein the annular bulge (28) and the pivot (8,14) define an annular space (30).

2. Assembly (50) according to claim 1, characterised in that said tubular component (26) is mounted on the pivot (8,14) of the blade (4) such that the first annular zone (26*a*) is interposed along the axis (A) of said pivot (8,14) between the annular bulge (28) and a support plate (20) of the vane (6).

3. Assembly (50) according to claim 1, characterised in that a third annular zone (26*c*) is formed on the tubular component (26) along the axis (A) of said pivot (8,14) such that the second annular zone (26*b*) is interposed between the first annular zone (26*a*) and the third annular zone (26*c*); wherein the third annular zone (26*c*) comprises an annular face (32) radially internal in relation to the axis (A) of the pivot (8,14) in contact with said pivot (8,14).

4. Assembly (50) according to claim 3, characterised in that said annular face (32) is convex rounded shape.

5. Assembly (50) according to claim 1, characterised in that the annular bulge (28) comprises a face that is radially internal (28*a*) in relation to the axis (A) of the pivot (8,14) which is concave and a face that is radially external (28*b*) in relation to the axis (A) of the pivot (8,14) which is convex.

6. Assembly (50) according to claim 1, characterised in that the first zone (26*a*) is formed at a first end (34) of the tubular component (26).

7. Assembly (50) according to claim 3, characterised in that the third annular zone (26*c*) is formed at a second end (36) of the tubular component (26).

8. Assembly (50) according to claim 1, characterised in that said pivot (14) is formed at the end of the blade (4) that is radially internal in relation to the longitudinal axis (B).

9. Assembly (50) according to claim 1, characterised in that the ring (16) comprises a plurality of housings (18), regularly distributed around the axis of the ring.

10. Assembly (50) according to claim 9, characterised in that said tubular component is mounted coaxially around a pivot (8,14) and is accommodated in one of the housings (18), such that the radially external face (28*b*) of the annular bulge (28) is stressed radially towards the inside of the housing.

11. Assembly (50) according to claim 10, characterised in that said plurality of housings (18) each respectively receives a bush (38) in which a tubular component (26) surrounding a pivot (14) is engaged.

12. Turbine engine comprising at least one assembly according to a compressor according to claim 10.

13. Assembly (50) according to claim 9, characterised in that said plurality of housings (18) each respectively receives a bush (38) in which a tubular component (26) surrounding a pivot (14) is engaged.

14. Turbine engine compressor characterised in that it comprises at least one assembly according to claim 1.

15. Turbine engine comprising at least one assembly according to claim 1.

16. A high-pressure compressor characterised in that it comprises at least one assembly according to claim 1.

17. A turbojet or a turboprop comprising at least one assembly according to claim 1.

* * * * *